US007048643B2

(12) United States Patent
Welsh et al.

(10) Patent No.: US 7,048,643 B2
(45) Date of Patent: May 23, 2006

(54) DO-DROP GOLF PUTTER

(76) Inventors: Richard Paul Welsh, 1111 McCabe St., Rock Springs, WY (US) 82901; Michael William Welsh, 1025 Cypress Cir., Rock Springs, WY (US) 82901

( * ) Notice: Subject to any disclaimer, the term of this patent is extended or adjusted under 35 U.S.C. 154(b) by 127 days.

(21) Appl. No.: 10/449,899

(22) Filed: Jun. 2, 2003

(65) Prior Publication Data

US 2004/0242340 A1 Dec. 2, 2004

(51) Int. Cl.
*A63B 53/00* (2006.01)

(52) U.S. Cl. ..... 473/293; 473/294; 473/295; 473/340; 473/313; 473/314; 473/409

(58) Field of Classification Search ..... 473/293–297, 473/313–314, 299, 213–216, 409; D21/756–757
See application file for complete search history.

(56) References Cited

U.S. PATENT DOCUMENTS

| | | | | |
|---|---|---|---|---|
| 760,161 | A | | 5/1904 | Smith |
| 1,305,952 | A | * | 6/1919 | Suesman ..... 473/295 |
| 1,616,377 | A | | 2/1927 | Knight |
| D104,642 | S | | 5/1937 | Sylvester |
| 2,445,718 | A | | 7/1948 | Sternberg et al. |
| 3,182,401 | A | | 5/1965 | Stevens |
| 3,198,525 | A | | 8/1965 | Smith |
| 3,430,963 | A | | 3/1969 | Wozniak et al. |
| 3,459,426 | A | | 8/1969 | Sherwood |
| 3,462,155 | A | | 8/1969 | Pelz |
| 3,495,834 | A | | 2/1970 | Tanczos |
| 3,533,630 | A | | 10/1970 | Monaco |
| 3,663,019 | A | | 5/1972 | Palotsee |
| 3,679,207 | A | | 7/1972 | Florian |
| 4,174,838 | A | | 11/1979 | Paschetto |
| 4,211,415 | A | | 7/1980 | Lindo |
| 4,227,694 | A | | 10/1980 | Drake |
| 4,252,317 | A | | 2/1981 | Vezina |

(Continued)

FOREIGN PATENT DOCUMENTS

| | | | |
|---|---|---|---|
| JP | 10-15134 | * | 1/1998 |
| JP | 410015134 A | | 1/1998 |

*Primary Examiner*—Stephen Blau
(74) *Attorney, Agent, or Firm*—Thorpe North & Western LLP

(57) ABSTRACT

A golf putter having a bent shaft and designed to be used with an individual facing the intended travel direction of the launched golf ball. The golf putter comprises a bent shaft configuration, an upper handle assembly having a rotating upper grip, a fixed lower grip, and a putter head assembly. In operation, the right-handed individual will hold the golf putter with the left hand grasping the rotating handle assembly and the right hand grasping the lower fixed grip. The left hand and the rotating upper grip are held against the abdomen for stability purposes. Using the right hand, the individual rotates the shaft rearward and then forward to make contact between the putter head and the golf ball. The present invention golf putter comprises unique symmetry allowing a left-handed individual to use the golf putter simply by reversing the hand positions described. By enabling the individual to face the cup, the proposed invention provides better sight alignment and enables a more natural swing. The present invention shaft configuration and the rotating grip assembly function to allow the putter head to operate in a smooth pendulum motion to trace a smooth arc around the upper rotating grip as it is held firmly against the individual's abdomen. This smooth pendulum motion in combination with the stability created by the proper positioning of the upper rotating grip, provide improved consistency and improved accuracy in putting.

20 Claims, 4 Drawing Sheets

U.S. PATENT DOCUMENTS

| | | | | | |
|---|---|---|---|---|---|
| 4,789,158 | A | | 12/1988 | Chiesa | |
| 4,884,813 | A | | 12/1989 | Cates | |
| 5,125,657 | A | | 6/1992 | Beil | |
| 5,127,650 | A | | 7/1992 | Schneller | |
| 5,152,533 | A | | 10/1992 | Radakovich | |
| 5,188,361 | A | | 2/1993 | Coombe | |
| 5,308,071 | A | | 5/1994 | Lewis | |
| D349,546 | S | | 8/1994 | MacDougall | |
| 5,401,022 | A | | 3/1995 | McCready | |
| 5,474,300 | A | | 12/1995 | Scalise et al. | |
| D369,394 | S | | 4/1996 | North | |
| 5,595,385 | A | | 1/1997 | Jablonski | |
| 5,672,117 | A | * | 9/1997 | Dar | 473/232 |
| 5,803,828 | A | * | 9/1998 | Huang | 473/300 |
| 6,039,656 | A | * | 3/2000 | Fireman | 473/131 |
| D425,951 | S | * | 5/2000 | Davis et al. | D21/736 |
| 6,190,266 | B1 | * | 2/2001 | Pamias | 473/294 |

* cited by examiner

DO-DROP GOLF PUTTER

FIELD OF THE INVENTION

This invention relates generally to sporting equipment, and more particularly to a putter to be used for putting a golf ball.

BACKGROUND OF THE INVENTION AND RELATED ART

Golf is a game played on a landscaped course generally consisting of 18 holes. Each hole begins with a tee area where players hit the ball into the fairway area. The Fairway can vary in length from 150 yards to 600 yards. At the end of each fairway is an area called the putting green. The putting green is a closely groomed grassy area that surrounds the actual hole or "cup" into which the golf ball must be hit or putt to complete the hole.

A particular type of club called the golf putter is generally used to putt the ball across the green and into the hole. Putter design varies, with most types designed to be used with the golfer facing the ball and with his shoulders and feet perpendicular to the ball path. Grasping the putter in both hands, the golfer positions the putter head near the golf ball and swings the putter first away from the ball (backswing) and then toward the ball (foreswing), impacting the ball and propelling it toward the cup.

Several putters, enabling straight-forward putting, have been disclosed according to U.S. Pat. No 3,212,641, No. 4,163,554, and No. 4,227,694. All such disclosures differ from the present invention in that they do not incorporate a bent shaft with a rotating upper grip handle assembly.

SUMMARY OF THE INVENTION

In light of the problems and deficiencies inherent in the prior art, the present invention seeks to overcome these by featuring a bent shaft putter, designed to be used with the golfer facing the golf hole.

In accordance with the invention as embodied and broadly described herein, the present invention features a golf putter configured to allow an individual to putt a golf ball. In one exemplary embodiment, the golf putter comprises: a shaft comprising a first portion parallel to and offset from a second portion, and a transition portion interconnecting the first and second portions, the first and second portions and the transition portion forming a nonlinear shaft configuration; an upper grip assembly extending perpendicularly from the first portion of the shaft and configured to be positioned laterally across the body of the individual, the upper grip assembly comprising an upper grip configured to rotate, and an upper grip retainer configured to retain the upper grip about the shaft; and a putter head assembly coupled to the second portion of the shaft and comprising a putter head configured to strike and launch a golf ball. The present invention golf putter is specifically configured to orient the individual in a position facing an intended direction of travel of the golf ball upon its launch, which is unlike conventional and even non-conventional golf putters.

In essence, the present invention golf putter comprises a nonlinear shaft putter, designed to facilitate or allow the individual to face the intended direction of travel of the launched golf ball (e.g., towards the hole or cup formed in a green). The upper handle assembly comprises a rotating upper grip, with the lower grip preferably being fixed. In operation, a right-handed individual will hold the putter with the left hand grasping the rotating handle assembly and the right hand grasping the lower fixed grip. The left hand, and the upper handle assembly being grasped, is designed and configured to be held laterally across the body of the individual, such as across the chest or abdomen. Using the right hand, the individual will rotate the shaft rearward and then forward to make contact between the putter head and the golf ball, thereby launching the golf ball in the intended direction. The symmetry of the present invention golf putter enables it to be interchangeably used by a left-handed individual simply by the left-handed individual grasping the respective handles or grips with the opposite hands, or in other words, reversing the hand positions described for a right-handed individual. By enabling the individual to face the cup, better sight alignment is facilitated, in addition to enabling the individual to undertake a more natural swing.

The unique nonlinear shaft configuration and the rotating grip assembly allow the putter head to function in a pendulum-like manner and to smoothly trace an arc around the solidly fixed position of the upper grip assembly as it is being held firmly against the body of the individual. This smooth pendulum motion in combination with the rotating upper grip and fixed lower grip provide for improved consistency and improved accuracy in putting.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

FIG. 4-B illustrates a detailed front view of the putter head of FIG. 4-A, which putter head attaches to the lower portion of the shaft.

DETAILED DESCRIPTION OF EXEMPLARY EMBODIMENTS

Figure 1:
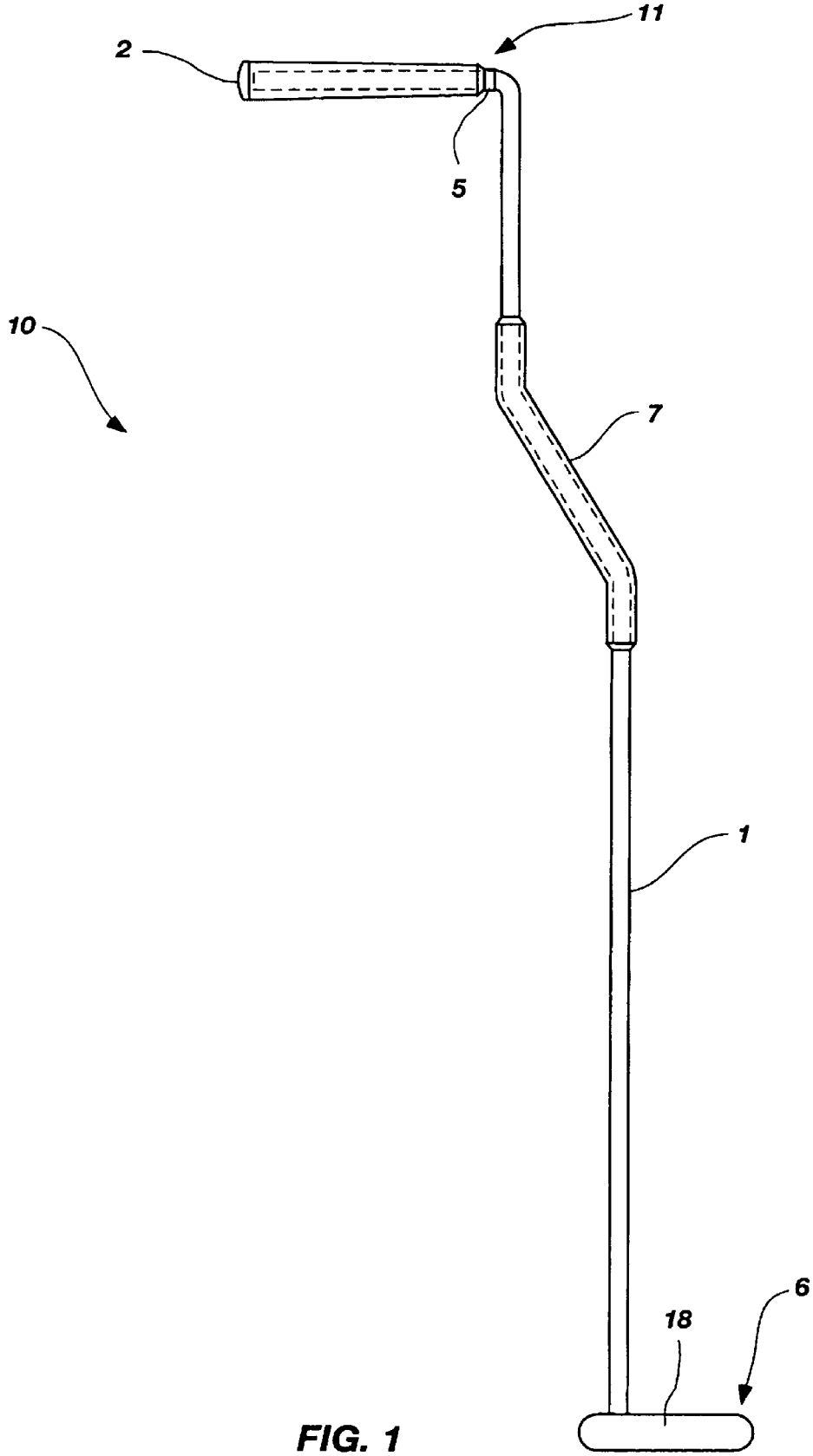
FIG. 1 illustrates a front view of the assembled golf putter according to one exemplary embodiment of the present invention.

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art practice the invention, it should be understood that other embodiments may be realized and that various changes to the invention may be made without departing from the spirit and scope of the present invention.

Thus, the following more detailed description of the embodiments of the present invention, as represented in FIGS. 1 through 4-B, is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

The present invention describes a method and system for providing a golf putter having a bent shaft configuration and coupled rotating handle assembly for facilitating a golfer to orient his or her body towards the hole while putting a golf ball.

FIGS. 1–4-B illustrate several views of the assembled golf putter according to one exemplary embodiment of the present invention. Specifically, and with reference to FIGS. 1–4-B, the present invention golf putter 10 comprises a shaft 1 (detailed in FIGS. 1 and 2) having a nonlinear configuration; a rotating upper grip assembly 11 (detailed in FIG. 3) disposed about the shaft 1 and having an upper grip 2 rotatably supported about the shaft 1, an upper grip retainer 3, and a low friction bearing member in the form of a bushing 4; a putter head assembly 6 (detailed in FIG. 4) having a putter head 18; and a lower grip 7 disposed about and preferably fixed to the shaft 1.

The shaft 1 comprises a first portion, a second portion, and a transition portion interconnecting the first and second portions, as shown in FIG. 1, thus forming a nonlinear shaft configuration. The first portion is parallel to the second portion. The transition portion is angled such that two alternate interior angles are formed to provide ergonomic positioning of the transition portion and the lower grip, and to orient the first and second portions in an offset position from one another.

The shaft 1 may further comprise an extension member extending perpendicularly from the first portion, which extension member is preferably configured so as to be parallel to the putter head 18. The extension member is also configured to rotatably support the upper handle assembly. Each of the various elements of the shaft 1 may be formed of a single, unitary structure.

Figure 2:
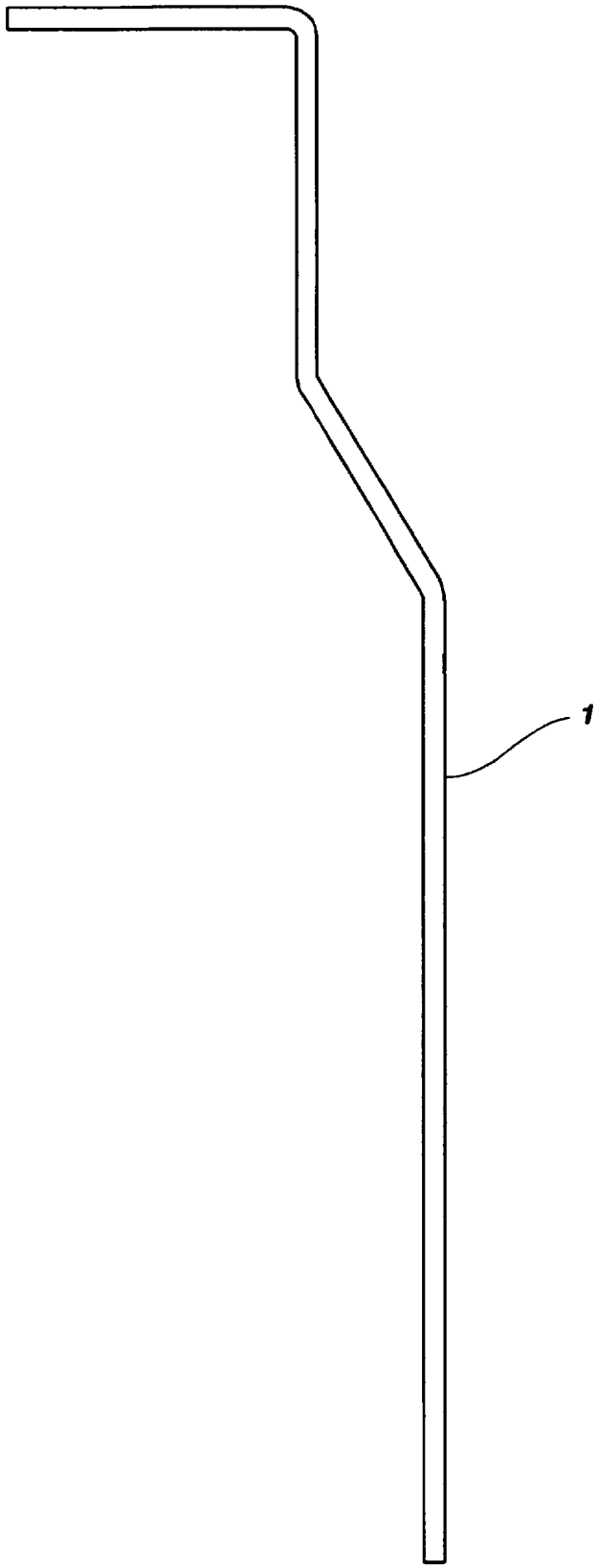
FIG. 2 illustrates ad detailed view of the shaft of the exemplary golf putter depicted in FIG. 1.

The shaft 1 is preferably made of one-half inch diameter, soft annealed, ASTM A269, stainless steel tubing with a wall thickness of 0.070 inches, bent in the configuration shown in FIG. 2. The shaft 1 is preferably configured to be a planar shaft.

Figure 3:
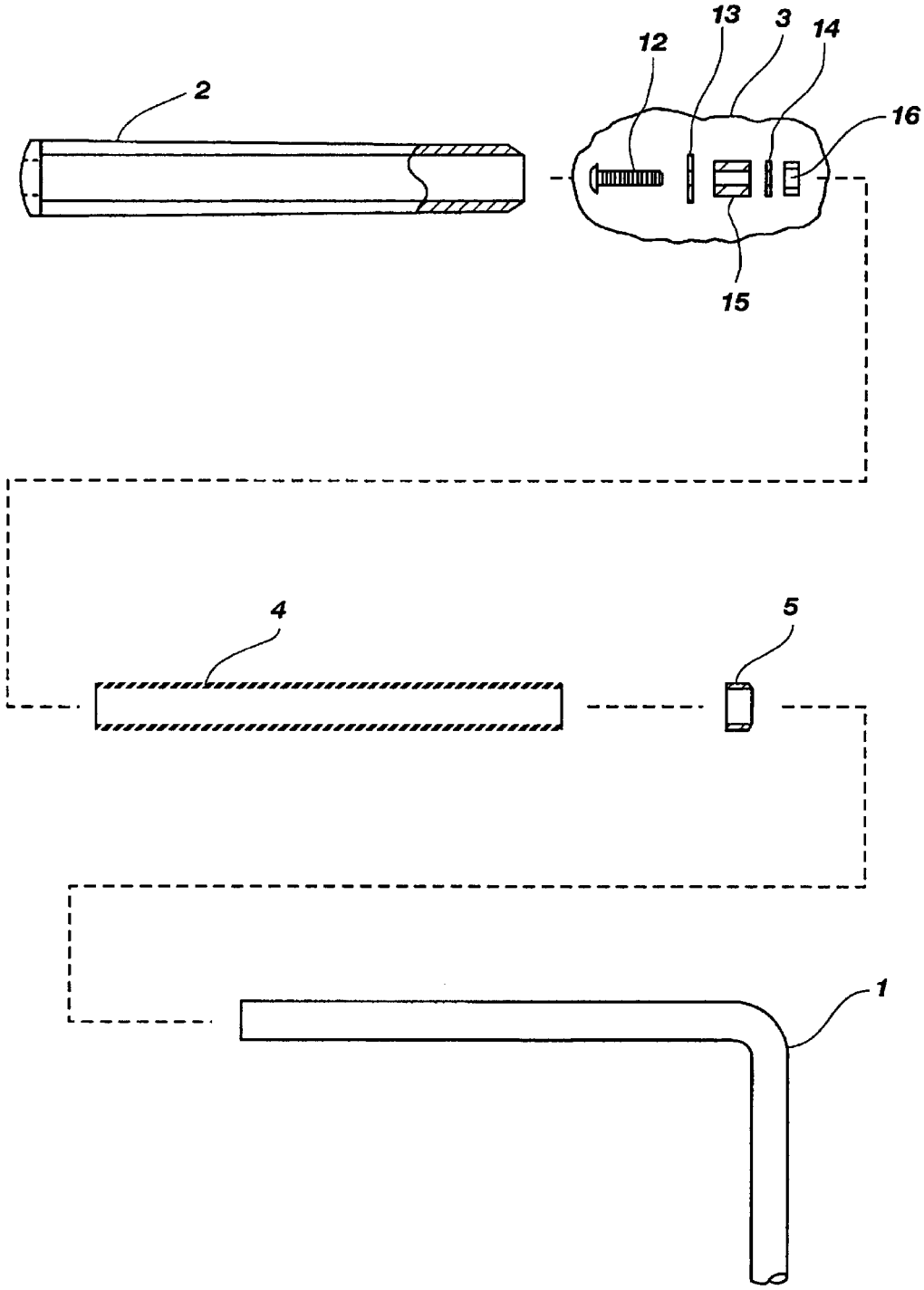
FIG. 3 illustrates an exploded view of the upper handle assembly of the golf putter depicted in FIG. 1, which upper handle assembly attaches to the upper portion of the shaft.
Figure 4A:
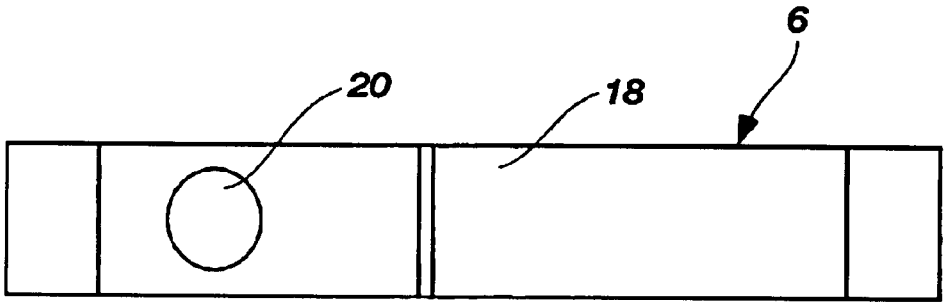
FIG. 4-A illustrates a detailed top view of the putter head according to one exemplary embodiment, which putter head attaches to the lower portion of the shaft.
Figure 4B:
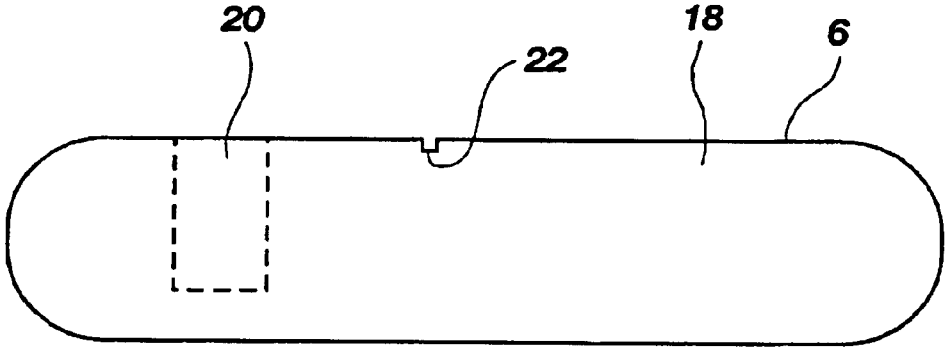

The rotating upper grip assembly 11 is shown in detail in FIG. 3. The upper grip 2 is preferably made of a rubber or leather material. The upper grip 2 is configured to slide over the bushing 4. The bushing 4 is held in position on the shaft by a thrust collar 5 and an upper grip retainer 3. The thrust collar 5 is an interference fitted sleeve that is pressed over the shaft 1 to a position on the inside portion of the rotating handle or grip 2. The interference fit locks the thrust collar 5 to the shaft 1. The thrust collar 5 comprises an outer diameter that is the same or slightly smaller than the outer diameter of the bushing 4 in order to oppose bushing thrust while allowing free rotation of the grip 2. The bushing 4 is slid onto the shaft 1 until it contacts the thrust collar 5. The edges of the thrust collar 5 and of the bushing 4 engage one another to keep the bushing 4 from sliding forward on the shaft.

The upper grip assembly 11 is configured to be held laterally across the abdomen. The configuration of the upper grip assembly 11 with respect to the shaft 1 functions to provide the individual with the ability to face the intended direction of travel of the launched golf ball. For example, the individual may directly face the hole or cup formed in the green while putting. This is unlike prior related golf putters, wherein the individual typically faces in a direction orthogonal from the intended direction of travel of the golf ball.

The upper and lower grips are preferably formed of a material selected from rubber, rubber elastomer, leather, an open-cell foam, and a closed-cell foam.

The upper grip retainer 3 preferably comprises an expansion plug-type. As shown, the upper grip retainer 3 comprises a button head machine screw 12, two metal washers 13 and 14, a rubber washer 15, and a retaining nut 16. The outer metal washer 13 has an outer diameter is larger than the inner diameter of the bushing 4, but slightly smaller than the outer diameter of the bushing 4. The inner metal washer 14 will have an outer diameter slightly smaller than the inner diameter of the shaft 1. The rubber washer 15 is sandwiched between the two metal washers 13 and 14, and the machine screw 12 is inserted through the center of all the washers 13, 14, and 15 to form the upper grip retainer 3. The nut 16 will be threaded onto the machine screw 12 to hold the upper grip retainer 3 together. The nut 16 and inner washer 14 are stuck together and the inner washer 14 is pressed into the rubber washer 15.

The rotating upper grip assembly 11 is assembled by slipping the bushing 4 over the shaft 1 until it makes contact with the thrust collar 5. The upper grip retainer 3 is then inserted into the end of the shaft 1, and pressed inward until the outer washer 13 contacts the end of the shaft 1. The button head machine screw 12 is then tightened, expanding the rubber washer 15 against the inner surface of the shaft tubing, securing the upper grip retainer 3 to the shaft 1. The upper grip 2 is then slipped over the bushing 4 and upper grip retainer 3.

The putter head assembly 6 (shown in FIG. 4) is constructed of solid brass or a similar metal. The putter head 18 has a blind bore 20 into which the shaft 1 is pressed. The upper surface of the head may have a slight groove cut into it, shown as groove 22, to aid in the alignment of a golf ball. The front and rear faces of the head are preferably flat so that the golf putter 10 may be used ambidextrously.

To use the present invention golf putter, the right-handed individual faces the golf cup with the golf ball to his right. Grasping the rotating upper grip 2 with his left hand and holding the rotating upper grip 2 parallel to the ground, the individual positions the rotating upper grip 2 firmly against his abdomen. The individual then grasps the lower grip 7 with his right hand. He places the putter head behind the ball and gently swings the lower part of the shaft 1 rearward. He then reverses the motion, swings the golf putter 10 forward, thus causing the head of the putter to impact and launch the golf ball toward the cup. The golf putter 10 functions to swing freely or pendulum about the axis through the center of the rotating upper grip 2. Conversely, the left-handed individual is able to use the present invention golf club 10 simply by switching the left and right hand positions as described above.

There are several advantages found in the present invention. First, the present invention golf putter comprises unique symmetry allowing either left-handed and right-handed individuals to use the golf putter simply by reversing the hand positions described. Second, by enabling the individual to face the cup, the present invention golf putter provides better sight alignment and enables a more natural swing. Third, the present invention golf putter shaft configuration and the rotating grip assembly function to allow the putter head to operate in a smooth pendulum motion to trace a smooth arc around the upper rotating grip as it is held firmly against the individual's abdomen. This smooth pendulum motion in combination with the stability created by the proper positioning of the upper rotating grip, provide improved consistency and improved accuracy in putting.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to."

What is claimed and desired to be secured by Letters Patent is:

1. A golf putter configured to allow an individual to putt a golf ball, said golf putter comprising:

a shaft comprising a first portion parallel to and offset from a second portion, and a transition portion interconnecting said first and second portions, said first and second portions and said transition portion forming a nonlinear configuration;

an upper grip assembly extending perpendicularly from said first portion of said shaft and configured to be positioned laterally across the body of said individual, said upper grip assembly comprising an upper grip configured to rotate, and an upper grip retainer configured to retain said upper grip about said shaft; and a putter head assembly coupled to said second portion of said shaft and comprising a putter head configured to strike and launch a golf ball, wherein said golf putter is configured to orient said individual in a position facing an intended direction of travel of said golf ball.

2. The golf putter of claim 1, further comprising a lower grip disposed about said transition portion of said shaft, said lower grip being fixed about said shaft.

3. The golf putter of claim 2, wherein said upper and lower grips are interchangeably used to accommodate left and right-handed individuals.

4. The golf putter of claim 1, wherein said shaft comprises an extension member extending perpendicularly from said first portion and parallel to said putter head, said upper grip assembly being rotatably supported and disposed about said extension member.

5. The golf putter of claim 1, wherein said shaft comprises a single, continuous and unitary structure.

6. The golf putter of claim 1, wherein said transition portion is angled such that two alternate interior angles are formed to provide ergonomic positioning of said lower grip and to orient said first and second portions in an offset position from one another.

7. The golf putter of claim 1, wherein said putter head comprises opposing sides, each configured to strike and launch said golf ball.

8. The golf putter of claim 1, wherein said second portion is oriented perpendicular to said putter head.

9. The golf putter of claim 1, wherein said upper grip assembly further comprises a low friction bearing member configured to facilitate the rotation of said grip, said grip being supported about said low friction bearing member.

10. The golf putter of claim 9, wherein said low friction bearing member comprises a bushing made from a material having low coefficients of sliding and static friction.

11. The golf putter of claim 9, further comprising a thrust collar disposed about said shaft and configured to limit the position of said low friction bearing member about said shaft.

12. The golf putter of claim 11, wherein said thrust collar is configured to provide an interference fit about said shaft.

13. The golf putter of claim 11, further comprising an upper grip retainer configured to secure said low friction bearing about said shaft and against said thrust collar.

14. The golf putter of claim 13, wherein said upper and lower grips are formed of a material selected from the group consisting of rubber, rubber elastomer, leather, an open-cell foam, and a closed-cell foam.

15. The golf putter of claim 2, wherein said upper grip retainer comprises an expansion plug-type grip retainer, said low friction bearing member being retained on said shaft at an inner location by said thrust collar and at an outer location by said expansion plug-type grip retainer.

16. The golf putter of claim 15, wherein said expansion plug-type grip retainer comprises an outer washer having an outer diameter larger than an inner diameter of said low friction bearing member.

17. The golf putter of claim 1, wherein said putter head further comprises a bore in its top surface, said bore configured to receive said second portion of said shaft.

18. The golf putter of claim 1, wherein said putter head comprises a symmetrical configuration with respect to its longitudinal axis, thus enabling use by left and right-handed individuals.

19. The golf putter of claim 1, wherein said putter head comprises a groove formed therein for the purpose of facilitating proper alignment of said golf putter with a golf ball.

20. A method for facilitating the putting of a golf ball comprising:

providing a golf putter comprising:

a shaft comprising a first portion parallel to and offset from a second portion, and a transition portion interconnecting said first and second portions, said first and second portions and said transition portion forming a nonlinear configuration;

an upper grip assembly extending perpendicularly from said first portion of said shaft and configured to be positioned laterally across the body of an individual, said upper grip assembly comprising an upper grip configured to rotate, and an upper grip retainer configured to retain said upper grip about said shaft; and a putter head assembly coupled to said second portion of said shaft and comprising a putter head configured to strike and launch a golf ball wherein said golf putter is configured to orient said individual in a position facing an intended direction of travel of said golf ball.

* * * * *